United States Patent [19]

Takayanagi

[11] Patent Number: 4,882,558

[45] Date of Patent: Nov. 21, 1989

[54] SOLENOID ASSEMBLY

[75] Inventor: Makoto Takayanagi, Aichi, Japan

[73] Assignee: Aisin Seiki Kabushiki Kaisha, Aichi, Japan

[21] Appl. No.: 312,154

[22] Filed: Feb. 21, 1989

[30] Foreign Application Priority Data

Feb. 18, 1988 [JP] Japan ..... 63-36186

[51] Int. Cl.[4] ..... H01F 7/08

[52] U.S. Cl. ..... 335/260; 335/278; 251/129.15

[58] Field of Search ..... 335/255, 260, 278, 281; 251/129.15

[56] References Cited

U.S. PATENT DOCUMENTS 4,233,584 11/1980 Fussner ..... 335/260
4,326,696 4/1982 Ishikawa et al. ..... 335/260 X
4,405,912 9/1983 Palua et al. ..... 335/260
4,515,345 5/1985 Inden et al. ..... 335/260

*Primary Examiner*—George Harris
*Attorney, Agent, or Firm*—Sughrue, Mion, Zinn, Macpeak & Seas

[57] ABSTRACT

A solenoid assembly includes a coil bobbin having a pair of hooks extending in the longitudinal direction of the bobbin from a flange formed on one end of the bobbin and projecting radially outwardly from the axis of the bobbin at the ends thereof. A magnetic yoke having openings for receiving the hooks and a grommet having a base portion in contact with the magnetic yoke are seucred together by the hooks. The grommet has a neck portion extending in the axial direction of a magnetic core and a central opening for a lead wire to a coil on the bobbin. The magnetic yoke is fixed to one end of the magnetic core which is located in a central opening formed in the coil bobbin. A plastic casing is then molded about the entire assembly.

2 Claims, 3 Drawing Sheets

SOLENOID ASSEMBLY

BACKGROUND OF THE INVENTION

1. Field of the Invention

This invention relates generally to a solenoid assembly for driving a plunger by magnetic force and more particularly to a fastener arrangement for a solenoid assembly to maintain the components in a preset condition during a subsequent molding of a plastic casing about the assembly.

2. Description of the Prior Art

A conventional solenoid assembly has a casing made of metal and is comprised of a coil on a bobbin, a magnetic core, a magnetic plunger and a magnetic yoke which are arranged in the casing. In such a solenoid assembly, the metal casing is sometimes replaced or covered by a casing formed by plastic molding so as to improve the air-tightness of the interior of the solenoid assembly. For example, in a solenoid assembly disclosed in Japanese Kokai Application No. 58(1982)-11180 published on Jan. 24, 1983, a grommet for supporting a lead wire is arranged on a flanged portion formed on a coil bobbin whereby the lead wire is connected to an electric coil and a casing is subsequently formed by a plastic molding operation after all of the parts are arranged to hold the parts in assembled condition. However, during such a plastic molding operation to provide a casing, the grommet may receive non-symmetrical pressures whereby the grommet is displaced from the bobbin or the grommet is tilted relative to the bobbin with the result that the solenoid assembly is malformed.

SUMMARY OF THE INVENTION

The present invention has basically solved the foregoing disadvantages in the prior art. Therefore, one of the objects of the present invention is to provide a solenoid assembly having a grommet maintained in a preset position during a subsequent plastic molding of a casing.

The preset assembly provides a new and improved solenoid assembly comprising a coil bobbin having a pair of hook members extending in the longitudinal direction of the bobbin from a flange formed on one end of the bobbin and projecting radially outwardly from the axis of the bobbin at the ends of the hook members, a magnetic yoke having openings through which the hooks extend and a grommet having a base portion contacting the magnetic yoke and a neck portion extending in the axial direction of a magnetic core disposed in said bobbin and secured to the core, said grommet having a central opening extending through the base portion and the neck portion through which a lead wire extends and a pair of openings in said base portion through which said hook members extend to pre-fix said grommet to said core.

According to the above structure, the grommet is located directly over the magnetic core which is the central part of the solenoid assembly, and the lead wire penetrating through the grommet is electrically connected to a coil wound on the bobbin. Thus, the center of the grommet is secured over the center of the solenoid assembly so that the outer circumferential portions of the grommet will receive substantially the same pressure from all directions during plastic molding of a casing about the assembly.

Various other objects, features and attendant advantages of the present invention will be more fully appreciated as the same becomes better understood from the following detailed description when considered in connection with the accompanying drawings.

DETAILED DESCRIPTION OF THE PREFERRED EMBODIMENTS

Figure 1:
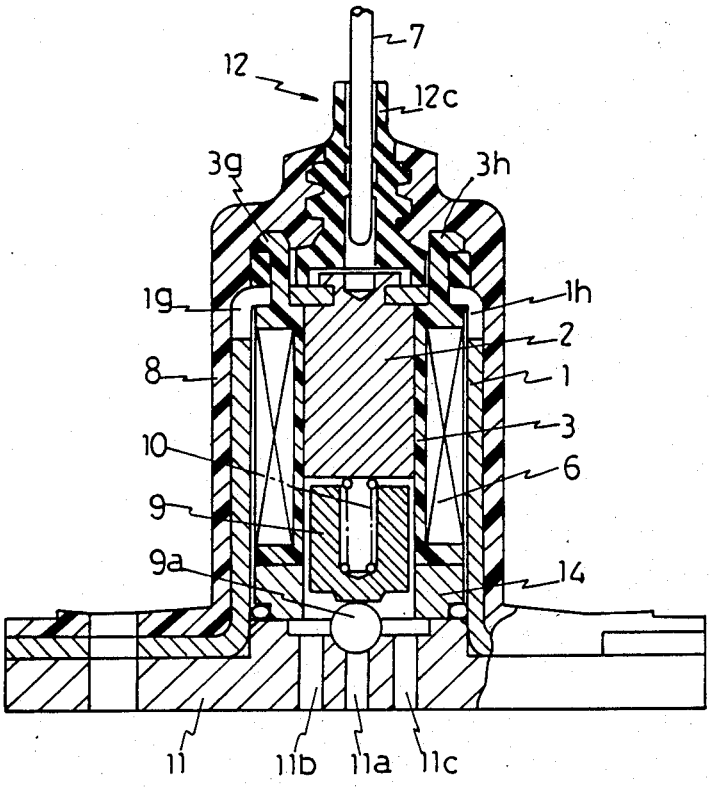
FIG. 1 is a cross sectional view of one embodiment of the present invention.

Referring to FIG. 1, a solenoid assembly is formed as a solenoid valve and has a casing 8 made by plastic molding. Each part of the solenoid valve is arranged in the casing 8.

A magnetic yoke 1 has an inverted U-shaped configuration and one end of magnetic core 2 is fixed to the bottom central portion of yoke 1. Both end portions of yoke 1 are fixed to a base plate 11 of metal. The core 2 is disposed in the upper portion of a central hole in bobbin 3. A magnetic plunger 9 is disposed in the lower portion of the central hole of bobbin 3 and biased downwardly by a compression spring 10 as shown in FIG. 1. A coil 6 is wound on bobbin 3 and is electrically connected to a lead wire 7.

An inlet 11*a* and outlets 11*b* and 11*c* are formed in the base plate 11. A ball valve 9*a* is arranged in a chamber which communicates the inlet 11*a* with outlets 11*b* and 11*c*. The ball valve 9*a* is normally biased by spring 10 through the plunger 9 into engagement with a seat surrounding inlet 11*a* to interrupt communication between the inlet 11*a* and outlets 11*b* and 11*c*.

A magnetic flux is generated in a loop comprised of core 2, plunger 9, magnetic end plate 14 and yoke 1 during the excited condition of coil 6 whereby the plunger 9 is attracted into contact with the core 2 against the biasing force of spring 10. Therefore, a fluid under high pressure supplied to inlet 11*a* lifts up valve 9*a* and is introduced into the operating chamber of plunger 9 and flows to outlets 11*b* and 11*c*.

Figure 2:
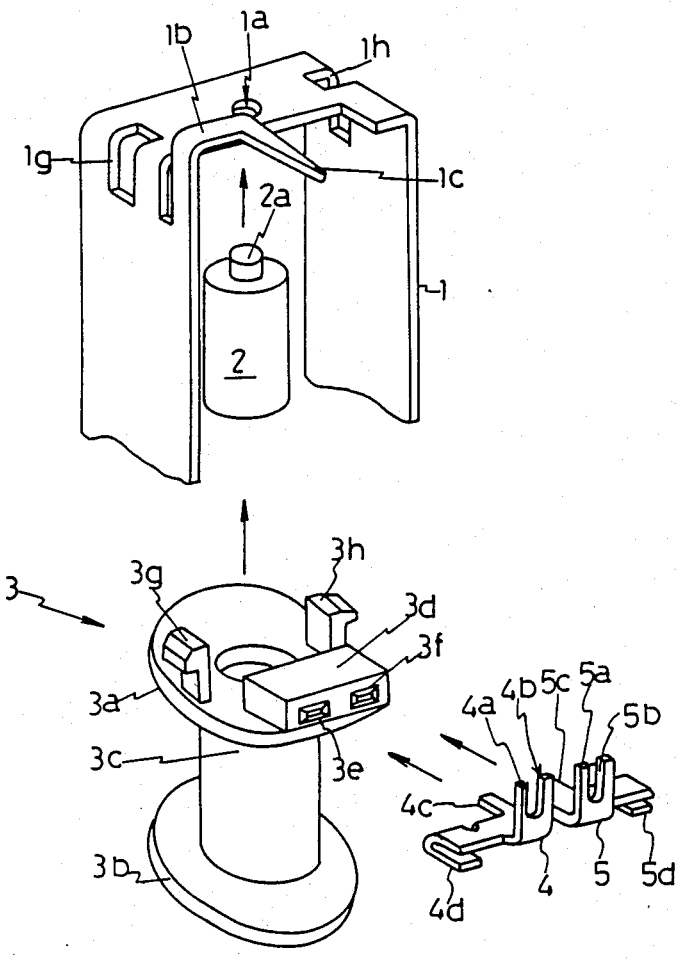
FIG. 2 is an exploded perspective view of a magnetic yoke and a coil bobbin.

Referring to FIG. 2, an L-shaped projecting arm 1*b* is unitarily formed on one side of yoke 1 and extends upwardly over the base portion which has a hole 1*a* for mounting core 2. The arm 1*b* is disposed substantially parallel to the bottom central portion of yoke 1. An engaging arm 1*c* is formed at the free end of arm 1*b* and extends perpendicular thereto. Arms 1*b* and 1*c* are formed as a ground terminal since the yoke 1 is electrically connected to the base plate 11 and the base plate 11 is connected to ground. After a projection 2*a* formed on the upper end of core 2 is inserted into hole 1*a* the core 2 is fixed to yoke 1 by swaging the projection 2*a*.

The bobbin 3 has a cylindrical portion 3*c*, flanges 3*a* and 3*b* at opposite ends of the cylindrical portion 3*c* and hooks 3*g* and 3*h* unitarily formed on flange 3*a*. The hooks 3*g* and 3*h* each have a top end portion extending radially outwardly from the axis of bobbin 3. A socket member 3*d* is formed on flange 3*a* and has a socket terminal 3*e* for connection to a ground terminal 4 and a socket terminal 3*f* for connection to a positive terminal 5.

The ground terminal 4 has an arm receiving member 4*a* having a U-shaped groove 4*b*, a plug 4*c* and a wire connecting portion 4*d*. The positive terminal 5 is formed symmetrically with respect to the ground terminal 4 and has a lead receiving member 5*a*, a plug 5*c* and a wire connecting portion 5*d*. The plug 4*c* of ground terminal 4 is engaged in socket terminal 3*e* by pressurized insertion thereof and the plug 5*c* of positive terminal 5 is engaged with socket terminal 3*f* by pressurized insertion thereof.

A coil 6 comprised of a wire having an electrical insulating paint thereon is wound around bobbin 3. A starting end of the wire of coil 6 is temporarily fixed to the wire connecting portion 5*d* of the positive terminal 5. A finishing end of the wire of coil 6 is fixed temporarily to the wire connecting portion 4*d* of ground terminal 4. Subsequently, both ends of the coil 6 are permanently fixed to wire connecting portions 4*d* and 5*d* by heating portions 4*d* and 5*d* under pressure whereby the electrical insulating paint is melted. As a result, both ends of the coil 6 and portions 4*d* and 5*d* will be electrically connected. This heating is generated by electric resistor heating.

Figure 3:
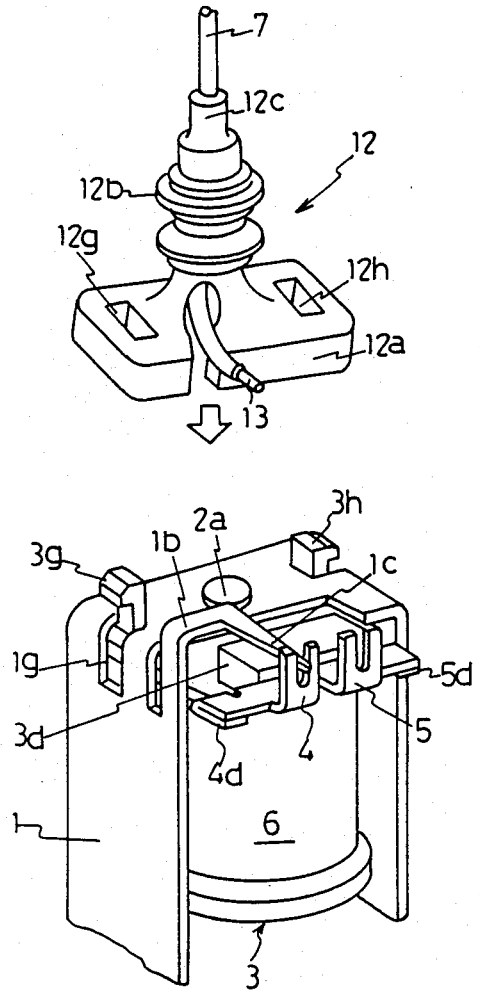
FIG. 3 is an exploded perspective view of a grommet and subassembly of the magnetic yoke and the coil bobbin.

The bobbin 3 having coil 6 thereon is assembled to yoke 1 wherein hooks 3*g* and 3*h* of bobbin 3 are passed through openings 1*g* and 1*h* formed in yoke 1 and core 2 is disposed in cylindrical portion 3*c* of bobbin 3 as shown in FIG. 3. At the same time, the engaging arm 1*c* of yoke 1 is located in the U-shaped groove 4*b* of ground terminal 4 which is fixed to bobbin 3.

Referring to FIG. 3, a grommet is provided for the insertion of a lead wire 7 through a central hole formed therein. The grommet 12 is in the form of a rubber bushing having a flat, rectangular bottom portion 12*a* and a neck portion 12*b* of one piece construction formed on the central portion of the bottom portion 12*a*. The grommet 12 has a hole for passing lead wire 7 wherein the hole penetrates from an upper end 12*c* of neck portion 12*b* through a lower surface of bottom portion 12*a*.

The bottom portion 12*a* of grommet 12 has rectangular holes 12*g* and 12*h* for snugly receiving hooks 3*g* and 3*h*. As shown in FIG. 3, hooks 3*g* and 3*h*, which pass through openings 1*g* and 1*h* in the yoke, are inserted under pressure in holes 12*g* and 12*h* whereby the top end portions of the hooks 3*g* and 3*h* extend above and engage the upper surface of bottom portion 12*a*. Thus, the grommet 12 is fixed to yoke 1, the neck portion 12*b* of the grommet 12 is located right over the central hole of bobbin 3, and the lead wire 7 is extended upwardly along the axis of bobbin 3.

The end 13 of lead wire 7 is set into the U-shaped groove 5*b* of positive terminal 5, the connecting arm 1*c* is electrically connected to ground terminal 4 by soldering and the wire end 13 is electrically connected to positive terminal 5 by soldering.

The valve parts such as spring 10, plunger 9 and valve 9*a* are then arranged in bobbin 3 and the yoke 1 is fixed to base plate 11 whereby the solenoid assembly is functionally completed. Finally, casing 8 is formed by plastic molding whereby the solenoid assembly is fully completed. The solenoid valve is grounded through ground terminal 4, engaging arm 1*c*, yoke 1 and base plate 11.

The grommet 12 engages hooks 3*g* and 3*h* which extend from bobbin 3 and is pressed down against yoke 1. The grommet 12 is located in a preset position and fixed at the position temporarily whereby the grommet 12 is located right over the axis of core 2, namely the center of the solenoid assembly. Therefore the outer circumferential portions of grommet 12 receive substantially the same pressure from all directions during plastic molding of the casing 8 and the neck portion 12*b* of the grommet 12 receives pressure pressing the grommet 12 against yoke 1. Consequently, the grommet 12 is maintained in the preset position permanently.

Obviously, many modifications and variations of the present invention are possible in light of the above teachings. It is therefore to be understood that within the scope of the appended claims the invention may be practiced otherwise than as specifically described herein.

What is claimed is:

1. A solenoid assembly comprising:

a magnetic core;

a coil bobbin having a longitudinal axis and hook means thereon extending in the longitudinal direction of the bobbin axis from a flange formed on one end thereof with an end portion of said hook means projecting radially outwardly from said axis; said bobbin having a central bore with at least a portion of said core disposed therein and a coil wound around said bobbin;

a magnetic yoke connected to said core and partially surrounding said coil and having opening means through which said hook means extend;

a magnetic plunger movably disposed in said bore adjacent said core;

a grommet having a base portion disposed in contact with said yoke and engaged by said hook means and a neck portion extending along the axis of said bobbin away from said base portion and having an opening for a lead wire in said neck portion;

a lead wire extending through said opening of said neck portion and connected to one end of said coil; and a casing made of plastic molded in situ and covering said grommet and an exterior portion of said yoke continuously.

2. A solenoid assembly of claim 1, further comprising valve means disposed in said casing in operative relation with said plunger.

* * * * *